United States Patent [19]

Mueller

[11] Patent Number: 4,746,018

[45] Date of Patent: May 24, 1988

[54] PAD ENCLOSURE

[75] Inventor: David C. Mueller, Ashland, Ohio

[73] Assignee: Minnesota Mining and Manufacturing Company, Saint Paul, Minn.

[21] Appl. No.: 906,334

[22] Filed: Sep. 11, 1986

[51] Int. Cl.[4] ..... B65D 73/00

[52] U.S. Cl. ..... 206/447; 206/460; 206/449

[58] Field of Search ..... 206/449, 96, 215, 425, 206/447, 460, 474, 472, 492

[56] References Cited

U.S. PATENT DOCUMENTS

| | | | |
|---|---|---|---|
| 1,763,763 | 6/1930 | Denmead | 206/96 |
| 1,885,856 | 11/1932 | Palmer | 206/96 |
| 2,015,906 | 10/1935 | Peltzer | 206/215 |
| 2,123,903 | 7/1938 | Lane et al. | 229/48.5 A |
| 2,325,021 | 7/1943 | Salfisberg | 206/492 |
| 2,450,558 | 10/1948 | Ogren | 206/215 X |
| 2,529,288 | 11/1950 | Gibson | 206/215 |
| 2,624,502 | 1/1953 | Evans | 206/315.11 X |
| 2,935,185 | 5/1960 | Will | 40/124.1 X |
| 3,167,181 | 1/1965 | Goodman | 206/460 X |
| 3,759,372 | 9/1973 | Venema | 206/472 |
| 4,244,511 | 1/1981 | Coleman | 206/492 X |

FOREIGN PATENT DOCUMENTS

| | | | |
|---|---|---|---|
| 878252 | 9/1963 | United Kingdom | 206/472 |

*Primary Examiner*—Stephen Marcus
*Assistant Examiner*—Tracy Graveline
*Attorney, Agent, or Firm*—Donald M. Sell; James A. Smith; William L. Huebsch

[57] ABSTRACT

An enclosure for a pad of notepaper including a rectangular elongate sheet of stiff paper material bent at scores to define along the length of the sheet an upper front portion adapted to overlie a part of the front surface of the pad, top, rear and bottom portions adapted to respectively overlie the top rear and bottom surfaces of the pad, and a lower front structure adapted to overlie a minor part of the front surface of the pad and having a recess adapted to frictionally and removably receive an end part of the upper front portion to close the enclosure.

5 Claims, 3 Drawing Sheets

PAD ENCLOSURE

TECHNICAL FIELD

The present invention relates to protective enclosures for pads of material such as notepaper.

DISCLOSURE OF THE INVENTION

The present invention provides an enclosure for pads of material such as note paper that can be easily opened to remove a sheet from the pad, protects the pad when it is being carried, for example, in a handbag or briefcase, and may be decorated to enhance the aesthetics of the enclosure.

According to the present invention there is provided an enclosure for a pad comprising a rectangular elongate sheet of stiff paper material having spaced transverse scores and being bent at the scores to define sequentially along the length of the sheet (1) an upper front portion adapted to overlie a major part of a front surface of the pad, (2) a top portion adapted to overlie and to be coextensive with a top surface of the pad, (3) a rear portion adapted to overlie and be coextensive with a rear surface of the pad (to which rear portion the pad may be attached by adhesive attachment means preferably provided on the rear portion of the enclosure), (4) a bottom portion adapted to overlie and be coextensive with a bottom surface of the pad, (5) a lower face portion, (6) a foldback portion, and (7) a guide portion. The face, foldback and guide portions are folded and attached together by novel means to provide a lower front structure adapted to overlie a minor part of the front surface of the pad and to define a recess between the guide and foldback portions adapted to frictionally and removably receive a distal end part of the front portion with the engaged front portion and lower front structure overlying and being coextensive with the front surface of the pad. The enclosure can be easily opened by pulling the distal end part of the upper front portion from the recess and pivoting the upper front portion and lower front structure away from the front of the pad to afford access to it, for example to write a note or remove a sheet; and can as easily be again closed by pivoting the upper front portion and lower front structure back over the front of the pad and reinserting the distal end part of the front portion into the recess.

BRIEF DESCRIPTION OF THE DRAWING

The present invention will be further described with reference to the accompanying drawing wherein like numbers refer to like parts in the several views, and wherein.

DESCRIPTION OF THE PREFERRED EMBODIMENT

Figure 1:
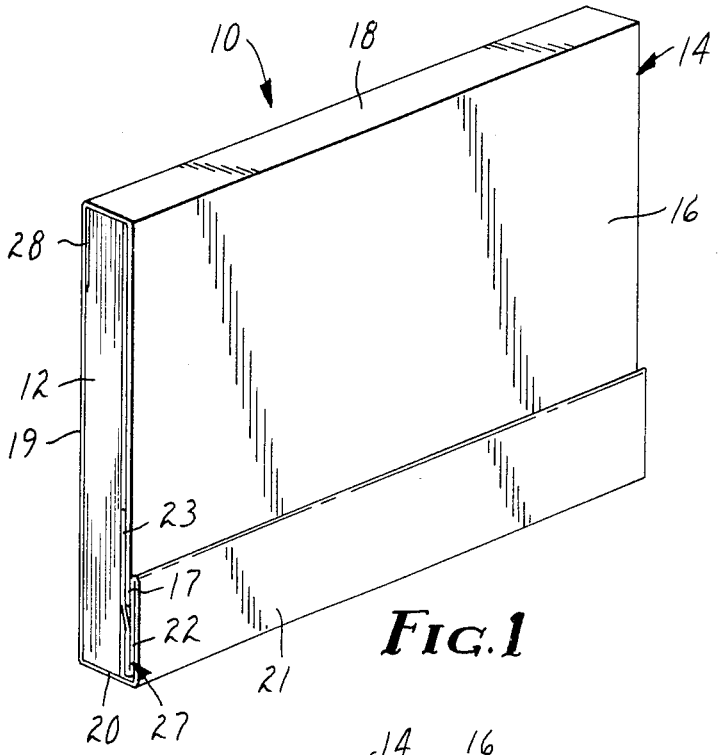
FIG. 1 is a perspective view of a first embodiment of an enclosure according to the present invention shown closed around a note pad.

Referring now to the drawing there is shown an enclosure for a pad according to the present invention generally designated by the reference numeral 10.

The enclosure 10 is adapted to cover front, rear, top and bottom surfaces of a pad 12 of notepaper (e.g., a pad 12 of the type commercially designated Scotch Brand "Post-it" TM Note Pad available from Minnesota Mining and Manufacturing Company, St. Paul, Minn.). The enclosure 10 comprises a rectangular elongate sheet 14 of stiff paper material, which sheet 14 has spaced transverse scores and is bent at the scores to define sequentially along the length of the sheet 14 an upper front portion 16 having a distal end part 17 and being adapted to overlie a major part of the front surface of the pad 12, a top portion 18 adapted to overlie and to be coextensive with the top surface of the pad 12, a rear portion 19 adapted to overlie and be coextensive with the rear surface of the pad 12, a bottom portion 20 adapted to overlie and be coextensive with the bottom surface of the pad 12, a lower face portion 21, a foldback portion 22 and a guide portion 23. The foldback portion 22 is parallel to and along the surface of the face portion 21 adapted to be adjacent the pad 12, and the guide portion 23 extends along, parallel to and past the surface of the foldback portion 22 opposite the face portion 21. The face, foldback, and guide portions 21, 22 and 23 are attached together adjacent the proximal end of the guide portion 23 to provide a lower front structure 27 adapted to overlie a minor part of the front surface of the pad 12 and to define a recess between the guide and foldback portions 22 and 23 adapted to frictionally and removably receive the distal end part 17 of the upper front portion 16 with the engaged upper front portion 16 and lower front structure 27 overlying and being coextensive with the front surface of the pad 12.

Preferably the enclosure 10 includes means for attaching the rear surface of the pad 12 to the rear portion 19 of the sheet 14, which means, as illustrated, is a strip 28 of pressure sensitive adhesive transverse of the rear portion 19 and adjacent the top portion 18 of the sheet. Preferably, the face, foldback and guide portions 21, 22 and 23 are attached together adjacent the proximal end of the guide portion 23 by adhesive which both 1) adheres the guide portion 23 to the foldback portion 22, and 2) in two elongate generally rectangular openings 30 through the foldback portion 22 adheres the guide portion 23 directly to the face portion 21.

Figure 2:
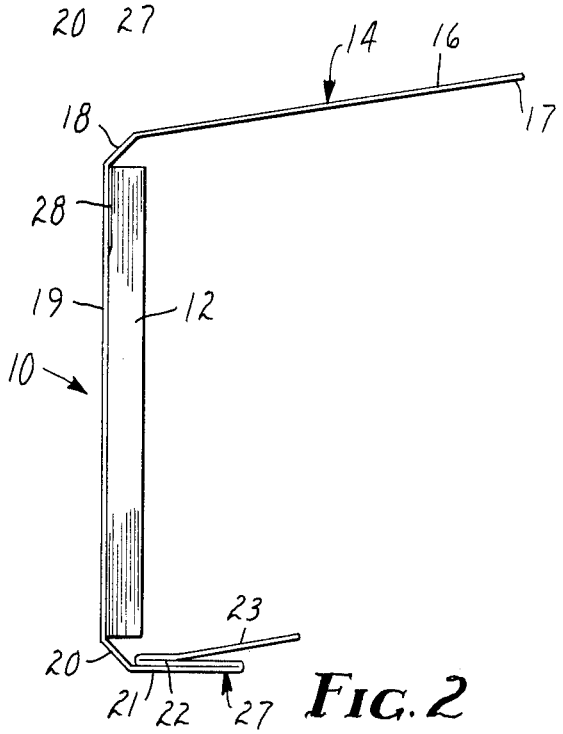
FIG. 2 is an enlarged end view of the enclosure and note pad of FIG. 1 shown with the enclosure open.

When the enclosure 10 is closed around the pad 12 as is shown in FIGS. 1 and 2, the top and bottom portions 18 and 20 are disposed at a right angle with respect to the upper front and rear portions 16 and 19 and the lower front structure 27. The enclosure can be easily opened, however, by pulling the distal end part 17 of the upper front portion 16 from the recess and pivoting the upper front portion 16 and lower front structure 27 away from the front of the pad 12 to afford access to the pad 12 to write a note or remove a sheet from the pad 12; and can as easily be again closed by pivoting the upper front portion 16 and lower front structure 27 back over the front of the pad 12 and reinserting the distal end part 17 of the upper front portion 16 into the recess.

The present invention has now been described with reference to one embodiment thereof. It will be apparent to those skilled in the art that many changes can be made in the embodiment described without departing from the scope of the present invention.

Figure 3:
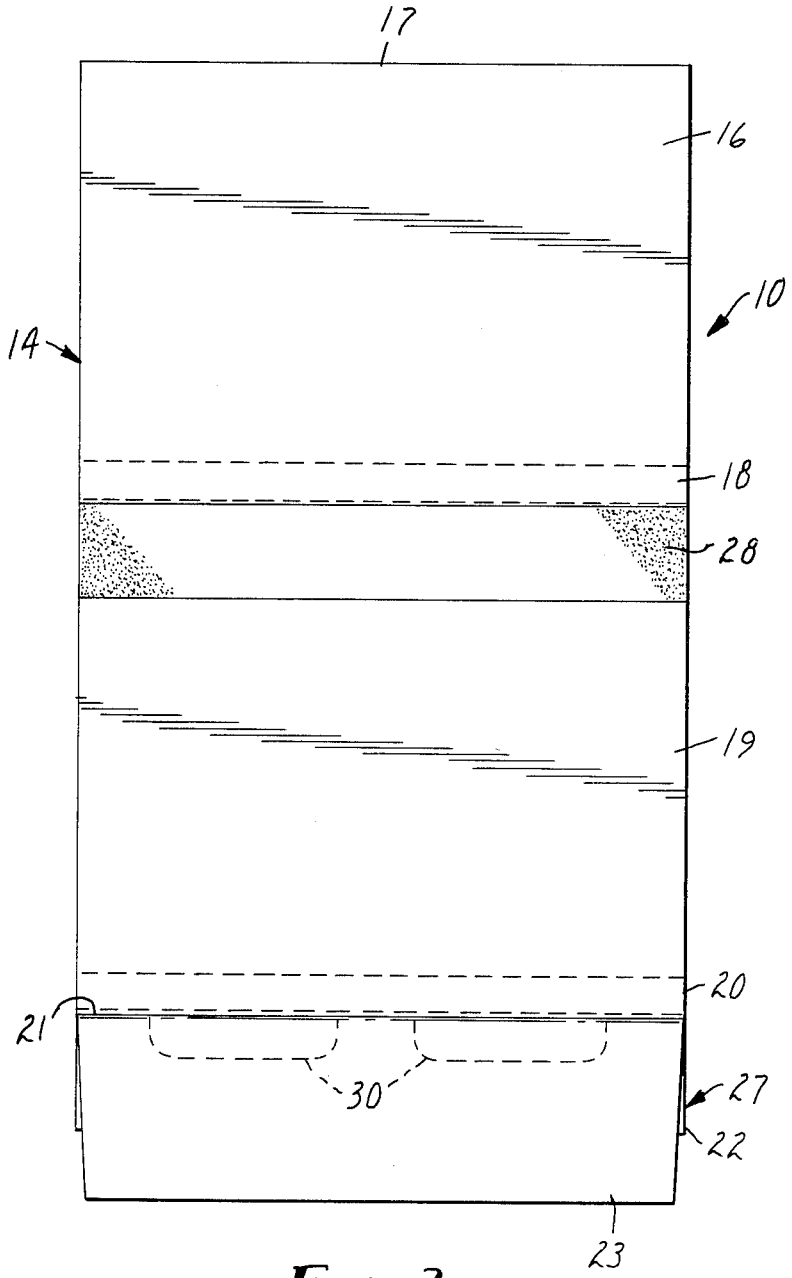
FIG. 3 is a plan view of the enclosure of FIG. 1 removed from the pad and lying with its portions generally in a single plane.
Figure 4:
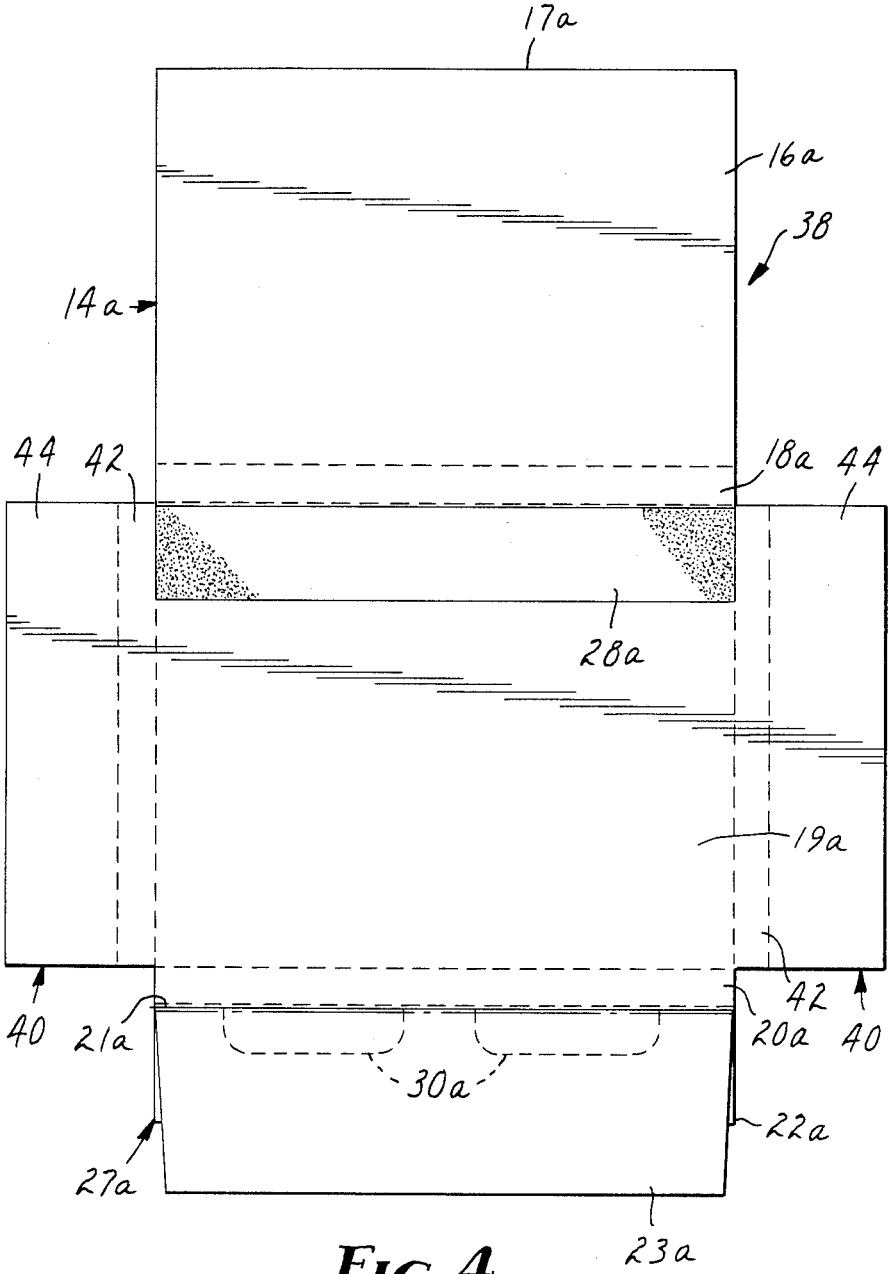
FIG. 4 is a plan view of a second embodiment of an enclosure according to the present invention lying with its portions generally in a single plane.

For example, as illustrated in FIG. 4 (wherein all parts common to the enclosure 10 of FIGS. 1 through 3 have the same reference numeral except for the addition of the suffix "a"), an enclosure 38 according to the present invention may comprise a sheet 14*a* of stiff paper material including projections 40 from both sides of the rear portion 19*a*, each of which projections 40 includes a side portion 42 adapted to overlie and be coextensive with the side surface of a pad and an end portion 44 adapted to overlie a part of the front surface of the pad under the front portion 16*a* and front structure 27*a*. This enclosure 38 is particularly useful if it is desired to also protect the sides of the pad, which could be the case, for example, for a pad of surgical tape.

Also, a pad may be attached in an enclosure according to the present invention so that when the enclosure is open, its upper front portion may be inserted between sheets in the pad to serve as a platen to support the outer sheet on the pad and protect lower sheets in the pad which may be useful when the pad includes paper that will be marked by pressure alone when it is written on.

Thus the scope of the present invention should not be limited to the structures described in this application, but only by structures described by the language of the claims and the equivalents of those structures.

I claim:

1. An enclosure for a pad of notepaper having front, rear, top and bottom surfaces, said enclosure comprising a rectangular elongate sheet of stiff paper material, said paper material having spaced transverse scores and being bent at said scores to define sequentially along the length of said sheet an upper front portion having a distal end part and being adapted to overlie a major part of the front surface of the pad, a top portion adapted to overlie and to be coextensive with the top surface of the pad, a rear portion adapted to overlie and be coextensive with the rear surface of the pad, a bottom portion adapted to overlie and be coextensive with the bottom surface of the pad, a lower face portion, a foldback portion and a guide portion, said foldback portion being parallel to and along the surface of said face portion adapted to be adjacent the pad and said guide portion extending parallel to and along and past the surface of said foldback portion opposite said face portion with said face, foldback and guide portions being attached together adjacent the proximal end of said guide portion while not being attached to said rear portion to provide a bottom front structure adapted to overlie a minor part of the front surface of the pad and to define a recess between said guide and foldback portions adapted to frictionally and removably receive the distal end part of said upper front portion with said engaged upper front portion and bottom front structure overlying and being coextensive with the front surface of the pad, with both the upper front portion and the lower front structure being pivotable away from the front of the pad upon removal of the distal end part of said upper front portion from said recess to afford access to the entire front of the pad.

2. An enclosure according to claim 1 wherein at least some of said portions have decorative outer surfaces.

3. An enclosure according to claim 1 wherein said enclosure includes means for attaching the rear surface of the pad to the rear portion of said sheet.

4. An enclosure according to claim 3 wherein said means for attaching comprises a strip of pressure sensitive adhesive.

5. An enclosure according to claim 1 wherein said foldback portion has at least one through opening adjacent said guide portion and said enclosure includes adhesive adjacent the proximal end of said guide portion adhering said guide portion to said foldback portion and said guide portion to said face portion through said opening.

* * * * *